US008511471B1

(12) United States Patent
Sannah

(10) Patent No.: US 8,511,471 B1
(45) Date of Patent: Aug. 20, 2013

(54) CRATE

(75) Inventor: Talal Sannah, Orange, CA (US)

(73) Assignee: Hisco, Inc., Houston, TX (US)

( * ) Notice: Subject to any disclaimer, the term of this patent is extended or adjusted under 35 U.S.C. 154(b) by 267 days.

(21) Appl. No.: 13/031,741

(22) Filed: Feb. 22, 2011

(51) Int. Cl.
*B65D 85/48* (2006.01)

(52) U.S. Cl.
USPC ..... 206/448; 206/600; 229/199

(58) Field of Classification Search
USPC ..... 206/386, 448, 449, 451, 454, 521, 206/591, 592, 594, 600; 108/51.3; 220/1.5; 229/122, 122.32, 122.33, 199
See application file for complete search history.

(56) References Cited

U.S. PATENT DOCUMENTS 1,809,953 A * 6/1931 Witte ..... 229/103.11
2,967,009 A * 1/1961 Lidgard ..... 206/448
4,182,450 A * 1/1980 Kryger ..... 206/448
4,225,043 A * 9/1980 Lastik ..... 206/448
4,353,466 A * 10/1982 Pater ..... 206/448
5,269,422 A * 12/1993 Chevrette ..... 206/448
5,564,344 A * 10/1996 Downes et al. ..... 108/56.3
5,595,125 A * 1/1997 Bridges, Jr. ..... 108/51.3
6,138,903 A * 10/2000 Baker ..... 229/122.33
6,290,064 B1 * 9/2001 Kuhn et al. ..... 206/600
2008/0041926 A1 * 2/2008 Goodrich ..... 229/199

* cited by examiner

*Primary Examiner* — Luan K Bui
(74) *Attorney, Agent, or Firm* — Buskop Law Group, PC; Wendy Buskop

(57) ABSTRACT

A crate made from cardboard configured to have increased compression strength is disclosed herein. The crate can include four sides with a space formed between the four sides. The space can be configured to be selectively closed. The crate can have a bottom secured to the four sides. One or more corrugated panels can be located within the space adjacent the four sides. The corrugated panels can be configured to support the four sides. The corrugated panels can include a corrugated material disposed between two sheets of material. One or more cuts can be located within the space.

5 Claims, 11 Drawing Sheets

CRATE

FIELD

The present embodiments generally relate to a crate configured to have increased compression strength.

BACKGROUND

A need exists for a crate that is lightweight and can be used to transport objects that are fragile, and provide protection and separation of objects being transported.

A further need exists for a crate that can be quickly assembled and easily transported.

An additional need exists for a crate that can be constructed of a lightweight material and reinforced with one or more corrugated panels to add increased compression strength thereto.

The present embodiments meet these needs.

BRIEF DESCRIPTION OF THE DRAWINGS

The detailed description will be better understood in conjunction with the accompanying drawings as follows.

Figure 1:
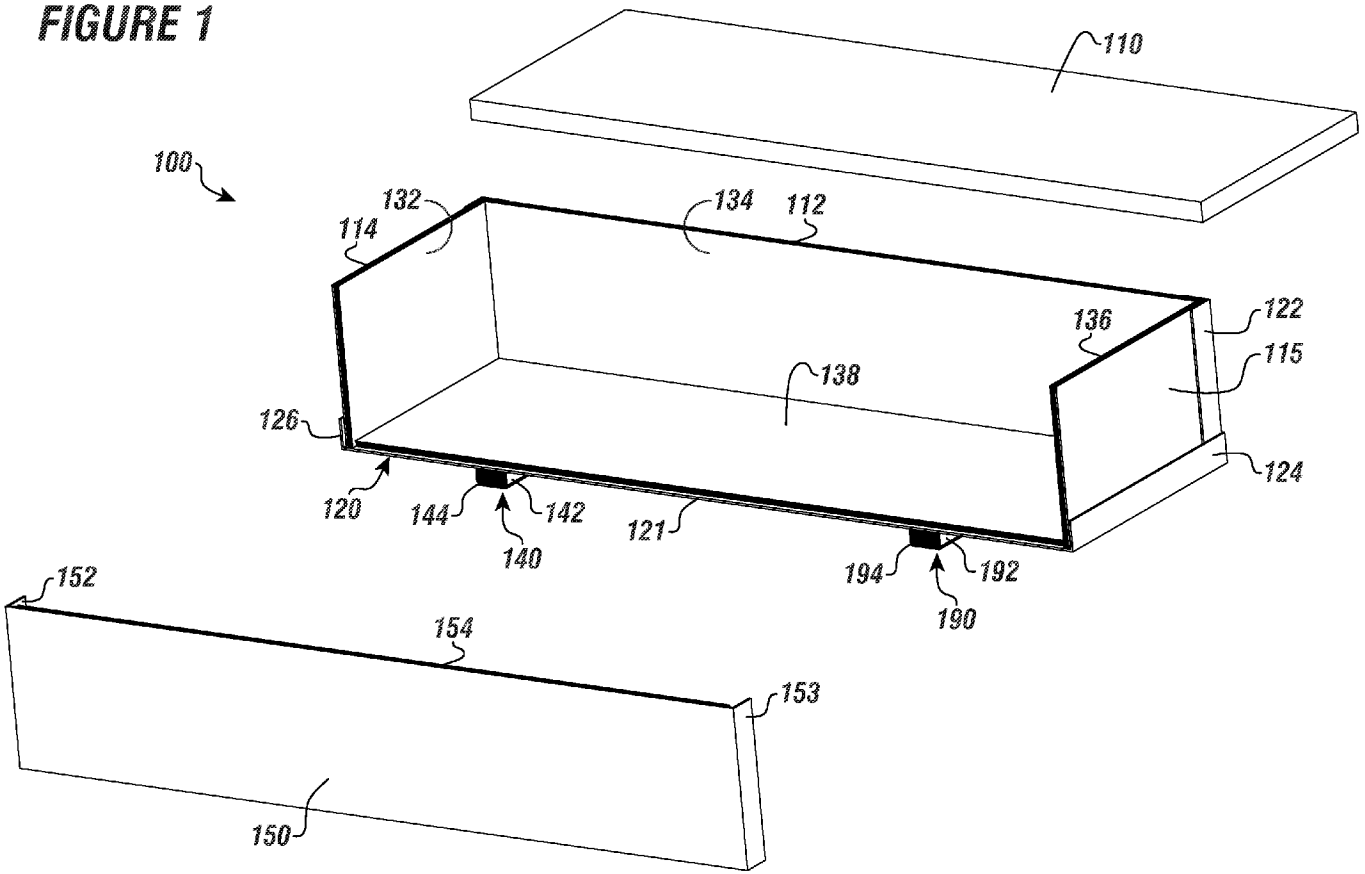
FIG. 1 depicts a prospective view of a crate according to one or more embodiments.

The present embodiments are detailed below with reference to the listed Figures.

DETAILED DESCRIPTION OF THE EMBODIMENTS

Before explaining the present crate in detail, it is to be understood that the crate is not limited to the particular embodiments and that it can be practiced or carried out in various ways.

The present embodiments generally relate to a crate. The crate can be configured to transport one or more objects. The crate can be lightweight.

The objects can be solar panels, wind turbine blades, flat and/or contoured aerospace parts, electronic components, objects having plates of glass, glass objects, ceramic objects, and other shippable objects.

One or more embodiments of the crate can be configured to have increased compression strength. The crate can include a space configured to receive an object. The space can be configured to be selectively closed. The space can be formed between one or more sides of the crate.

The crate can have one or more corrugated panels located within the space. The corrugated panels can be configured to support one or more portions of the crate.

One or more object supports can be located within the space. The object supports can be cuts, support members, or a space formed between insulated panels.

In one or more embodiments the crate can be made from cardboard and configured to have increased compression strength.

The crate can include four sides. The space can be formed between the four sides. The crate can also include a bottom secured to the four sides.

One or more corrugated panels can be located within the space. The corrugated panels can be adjacent the sides of the crate. For example, a first corrugated panel can be adjacent a first side of the crate, a second corrugated panel can be adjacent a second side of the crate, a third corrugated panel can be adjacent a third side of the crate, and a fourth corrugated panel can be adjacent a fourth side of the crate.

The crate can also include one or more cuts formed into a portion of the crate. For example, the cuts can be formed into the bottom of the crate, one or more of the sides of the crate, one or more flaps of the crate, one or more of the corrugated panels, a removable lid of the crate, or combinations thereof.

In one or more embodiments, one or more runners can be secured to a portion of the crate. For example, two runners can be secured to an exterior of the bottom of the crate. The runners can allow a fork lift or other lifting apparatus to operatively engage the crate. The runners can include an outer housing at least partially encasing a corrugated material. The outer housing can be rubber, metal, wood, cardboard, or combinations thereof.

In one or more embodiments, the crate can include one or more insulating panels. For example, one or more side insulating panels can be located adjacent one or more of the corrugated panels. A receiving space can be formed between the side insulating panels. The crate can also include a bottom insulating panel disposed on the bottom of the crate within the receiving space, and a top insulating panel configured to close off the receiving space. For example, the top insulating panel can be secured to one of the flaps or to a top corrugated panel.

In one or more embodiments the crate can also include a corrugated beam disposed between the sides. The corrugated beam can be supported by two corrugated supports adjacent two of the corrugated panels. The corrugated beam can have one or more cuts formed therein. The corrugated beams, panels, or other corrugated portions of the crates disclosed herein can include a corrugated material, such as Kraft paper, disposed between two sheets of material, such as cardboard. For example, the corrugated beams, panels, or other corrugated portions of the crates disclosed herein can be HEXACOMB™ or like products.

Turning now to the Figures, FIG. 1 depicts a prospective view of a crate according to one or more embodiments. The crate 100 can include one or more lids (one is shown 110), one or more base trays (one is shown 120), one or more runners (two are shown 140 and 190), one or more panels (three are shown 115, 114, and 112), one or more vertical corrugated panels (three are shown 132, 134, and 136), one or more horizontal corrugated panels (one is shown 138), and a removable front wall (one is shown 150).

The base tray 120 can include a horizontal member 121, a first horizontal flange 124, and a second horizontal flange 126. One or more vertical supports 122 can be on the base tray 120. The vertical supports 122 can be secured to the base tray 120 or formed into the base tray 120.

The runners 140 and 190 can include a first outer housing 142 and a second outer housing 192. The outer housings 142 and 192 can be cardboard or another material. For example, in one or more embodiments, the outer housings 142 and 192 can be made from plastic, steel, rubber, polymers, paper, synthetic material, composites, or combinations thereof. The first outer housing 142 can at least partially encase a first inner liner 144, and the second outer housing 192 can at least partially encase a second inner liner 194. The inner liners 144 and 194 can be Kraft paper, foam, rubber, polymers, HEXA-COMB™, like products, or combinations thereof.

The one or more panels, including a first panel 114, a second panel 115, and a third panel 112, can be constructed to support and protect objects disposed within the crate 100. For example, the panels 115, 114, and 112 can be made from cardboard, plastic, metal, metal alloys, polymers, composites, paper, wood, or combinations thereof.

The first panel 114 can be disposed adjacent the second horizontal flange 126. The first panel 114 can be secured to the third panel 112, the second horizontal flange 126, the horizontal member 121, an adjacent vertical flange, another portion of the crate 100, or combinations thereof. For example, an adhesive can be used to secure the first panel 114 to one or more other portions of the crate 100. The first panel 114 can have the first vertical corrugated panel 132 disposed thereon.

The second panel 115 can be located adjacent to the first horizontal flange 124. The second panel 115 can also be adjacent to the horizontal member 121 and the third panel 112. The second panel 115 can be secured to the horizontal member 121, the first horizontal flange 124, the third panel 112, the vertical supports 122, other portions of the crate 100, or combinations thereof. The second panel 115 can have the second vertical corrugated panel 136 disposed thereon.

The third panel 112 can be disposed adjacent to the vertical supports 122. The third panel 112 can be secured to the horizontal member 121, the first panel 114, the second panel 115, the vertical supports 122, another portion of the crate 100, or combinations thereof. The third panel 112 can have the third vertical corrugated panel 134 located thereon.

The vertical corrugated panels 132, 136, and 134 can be made from any material and can have any thickness. The vertical corrugated panels 132, 136, and 134 can be honeycomb shaped.

The horizontal corrugated panel 138 can be substantially similar to the one or more vertical corrugated panels 132, 136, and 134 described herein.

The removable front wall 150 can have one or more flaps (two are shown 152 and 153). The first flap 152 and the second flap 153 can be used to secure the removable front wall 150 to the first panel 114, the second panel 115, another portion of the crate 100, or combinations thereof. The flaps 152 and 153 are discussed in more detail below. The removable front wall 150 can also have a front corrugated panel 154. The front corrugated panel 154 can be substantially similar to other corrugated panels described herein.

One or more bottom additional corrugated panels can be disposed between the base tray 120 and the horizontal corrugated panel 138.

Figure 2:
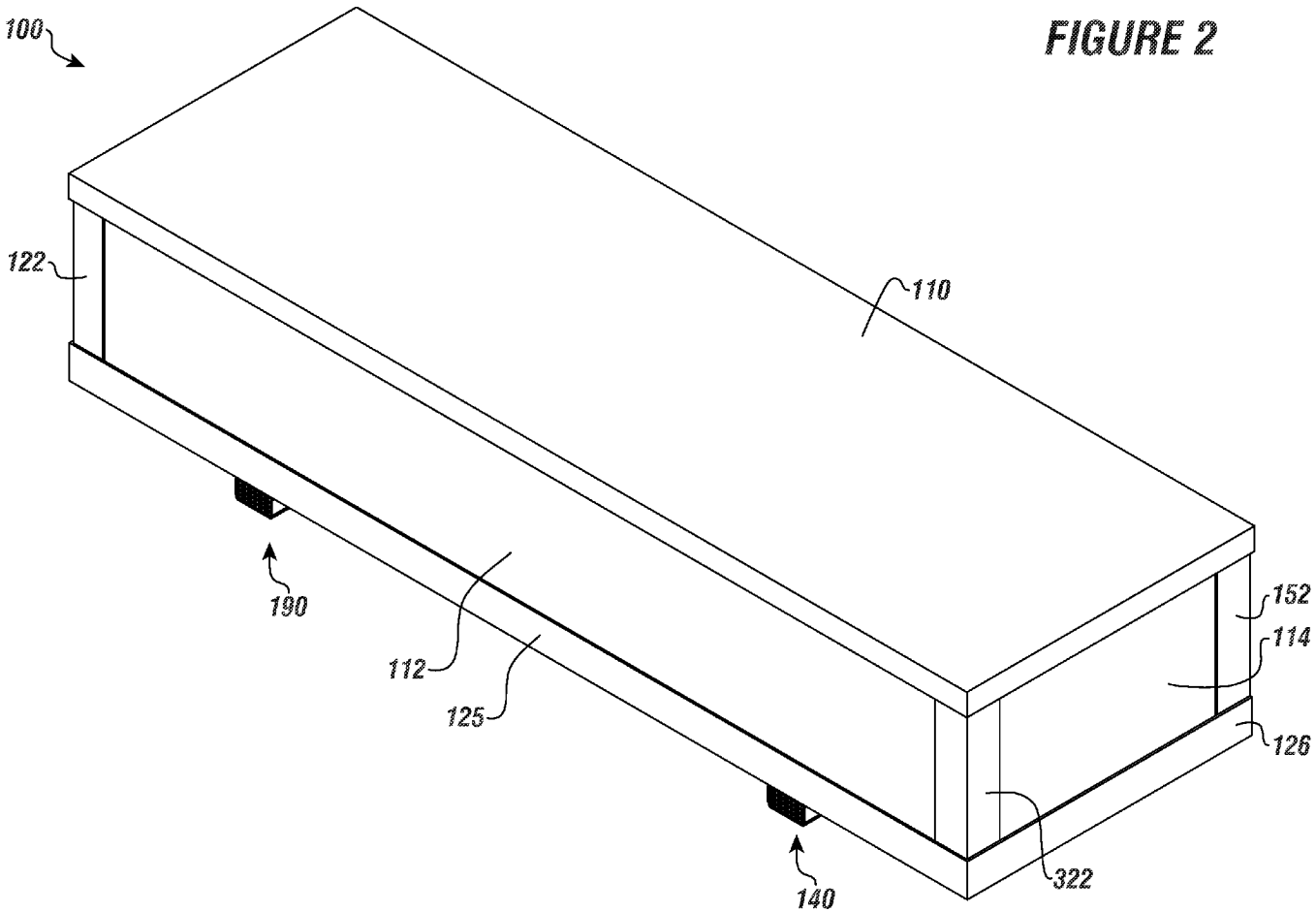
FIG. 2 depicts a back isometric view of the crate of FIG. 1 in an assembled configuration according to one or more embodiments.

FIG. 2 depicts a back isometric view of the crate of FIG. 1 in an assembled configuration according to one or more embodiments. The lid 110 can be disposed about a top portion of the crate 100. The first flap 152 can secure a portion of the removable front wall to the first panel 114. The vertical supports 122 and 322 can be disposed on opposite ends of the third panel 112. A back flange 125 can traverse the third panel 112. One end of the back flange 125 can be adjacent to the first vertical support 122, and another end of the back flange 125 can be adjacent to the second vertical support 322. The runners 190 and 140 can support the crate 100. The ends of the back flange 125 can abut the horizontal flanges, such as the second horizontal flange 126.

Figure 3:
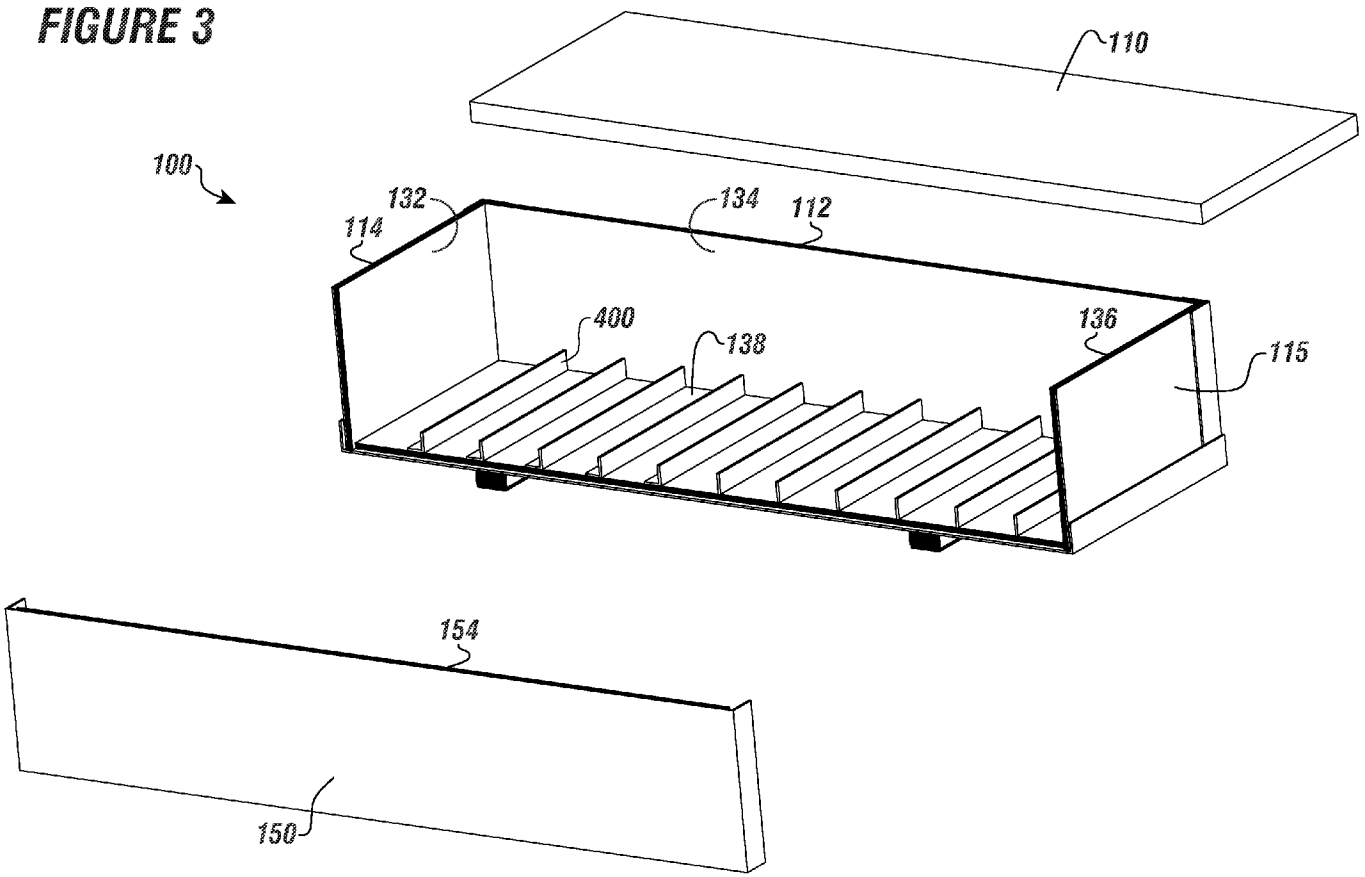
FIG. 3 depicts a plurality of separators connected to the crate of FIG. 1 according to one or more embodiments.

FIG. 3 depicts a plurality of separators connected to the crate of FIG. 1 according to one or more embodiments. The plurality of separators 400 can be secured to the horizontal corrugated panel 138. Another plurality of separators can be secured to the lid 110, the panels 114, 112, 115, the vertical corrugated panels 132, 136, 134, a corrugated panel on the lid 110, the front corrugated panel 154, the removable front wall 150, other portions of the crate 100, or combinations thereof. The plurality of separators 400 can have any shape. For example, the plurality of separators can have an L-shape, a U-shape, a C-shape, or combinations thereof.

Figure 4A:
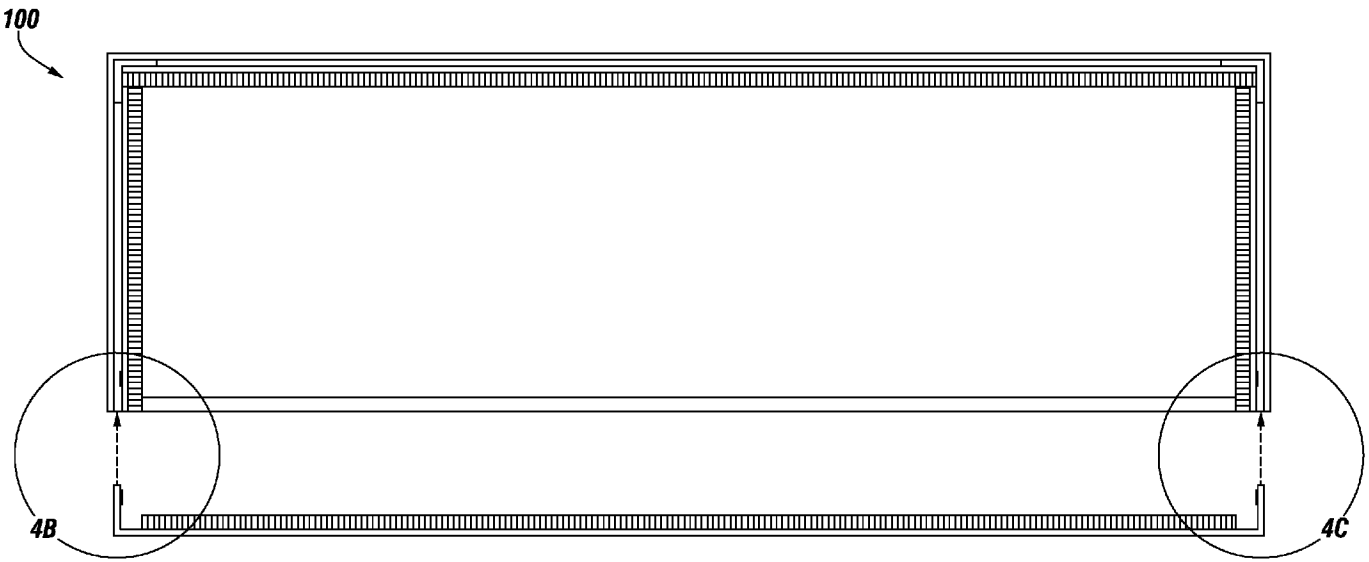
FIG. 4A depicts a top view of the crate of FIG. 1 according to one or more embodiments.
Figure 4C:
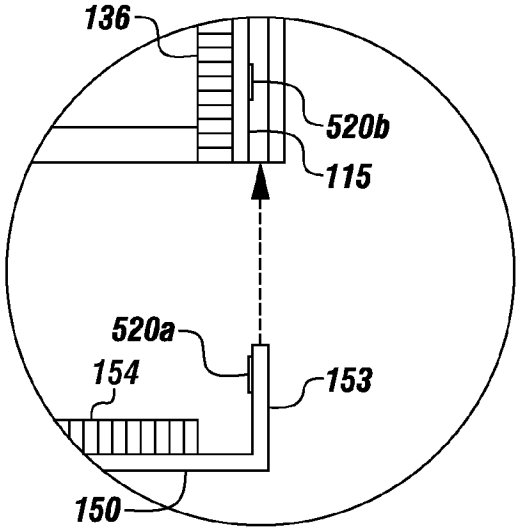
FIG. 4C depicts a detailed top view of another portion of the crate of FIG. 1.
Figure 4B:
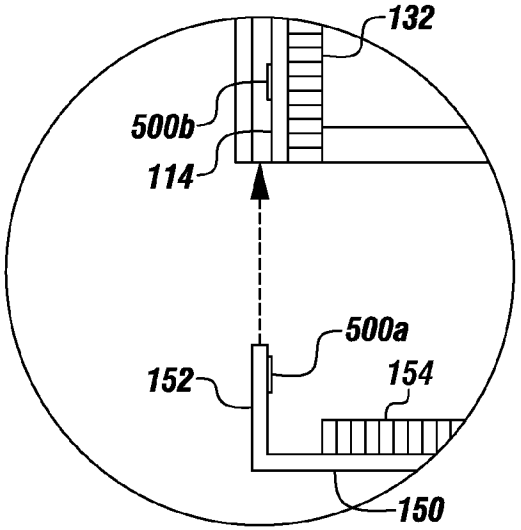
FIG. 4B depicts a detailed top view of a portion of the crate of FIG. 1.

FIG. 4A depicts a top view of the crate 100 of FIG. 1 according to one or more embodiments. FIG. 4B depicts a detailed top view of a portion of the crate of FIG. 1. FIG. 4C depicts a detailed top view of another portion of the crate of FIG. 1.

Referring to FIGS. 4A-4C, the first panel 114 can have a first portion of a first connector 500*b*, such as a hook and loop fastener, snap latch, double sided tape, or other mechanical fastener, located thereon. A second portion of a first connector 500*a* can be located on the first flap 152. A first portion of a second connector 520*b* can be located on the second panel 115. A second portion of a second connector 520*a* can be located on the second flap 153. The portions of the second connector 520*a* and 520*b* and the portions of the first connector 500*a* and 500*b* can be positioned on the removable front wall 150 and the crate 100 to allow the removable front wall 150 to at least partially cover the vertical corrugated panels 132 and 136 and the front corrugated panel 154 when they are connected to one another.

Figure 5:
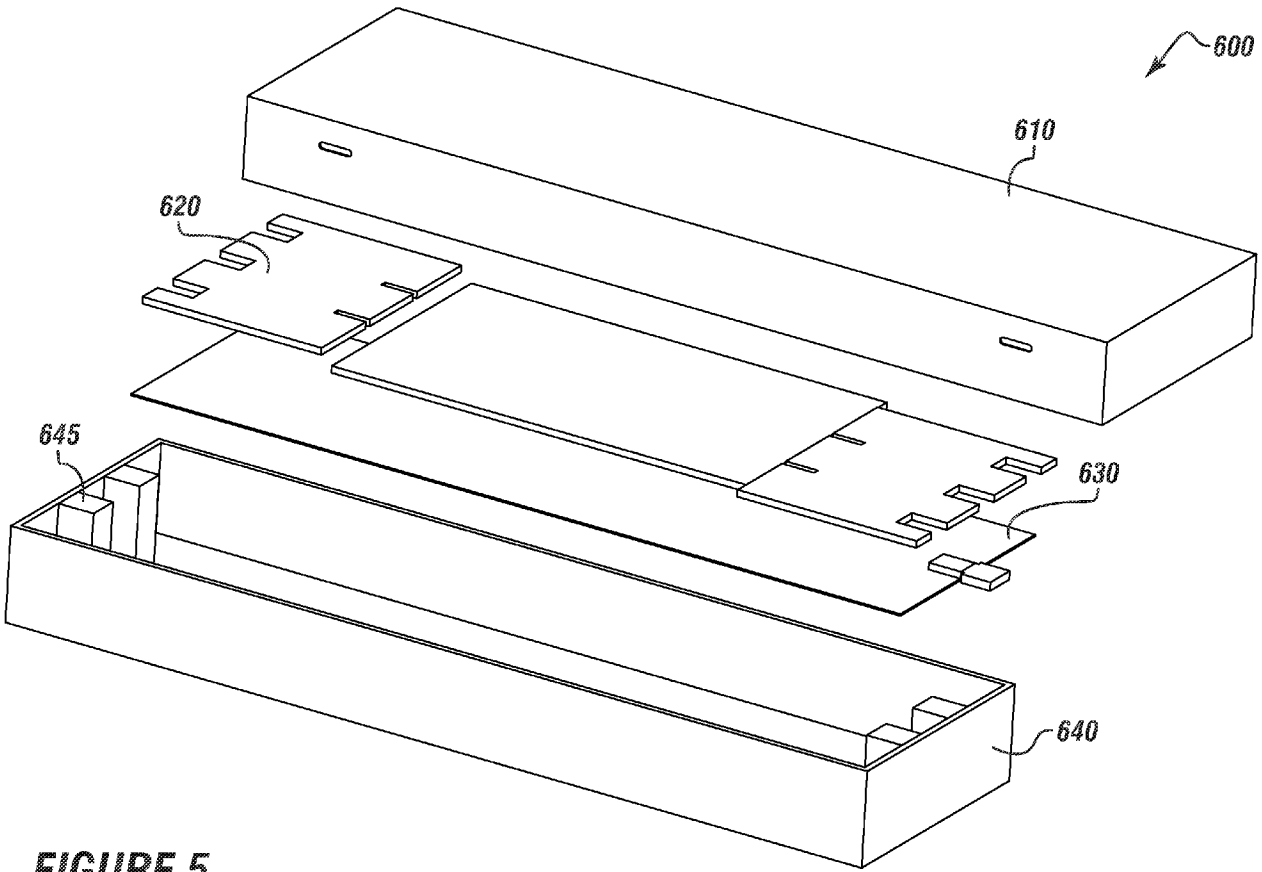
FIG. 5 depicts another crate according to one or more embodiments.

FIG. 5 depicts another crate according to one or more embodiments. The crate 600 can include a base 640, a lid 610, one or more corrugated blocks 645 disposed within the base 640, one or more corrugated panels 620, and one or more modules 630.

The base 640 can be configured to hold the module 630. The base 640 can be made from any material. Illustrative materials can include paper, cardboard, wood, plastic, metals, composites, other materials, or combinations thereof. The materials can be synthetic, natural, or both.

The corrugated blocks 645 can be made from HEXA-COMB™ or like products that are commercially available. In one or more embodiments, the corrugated blocks 645 can be connected to one or more portions of the base 640. For example, the corrugated blocks 645 can be connected to the base 640 using hot melt adhesive, hook and loop fasteners, other fasteners, or combinations thereof.

The corrugated panels 620 can have one or more cuts. The cuts can be formed by roll forming, manual raiser cuts, or otherwise. The cuts can be configured to support one or more objects within the crate 600.

The modules 630 can be one or more objects to be shipped in the crate 600. The modules 630 can be solar panels, electronics, glass panels, or the like.

The lid 610 can be made from any material. The lid 610 can have one or more handles. The lid 610 can be configured to close over the base 640. As such, the lid 610 and base 640 can encase the objects.

Figure 6:
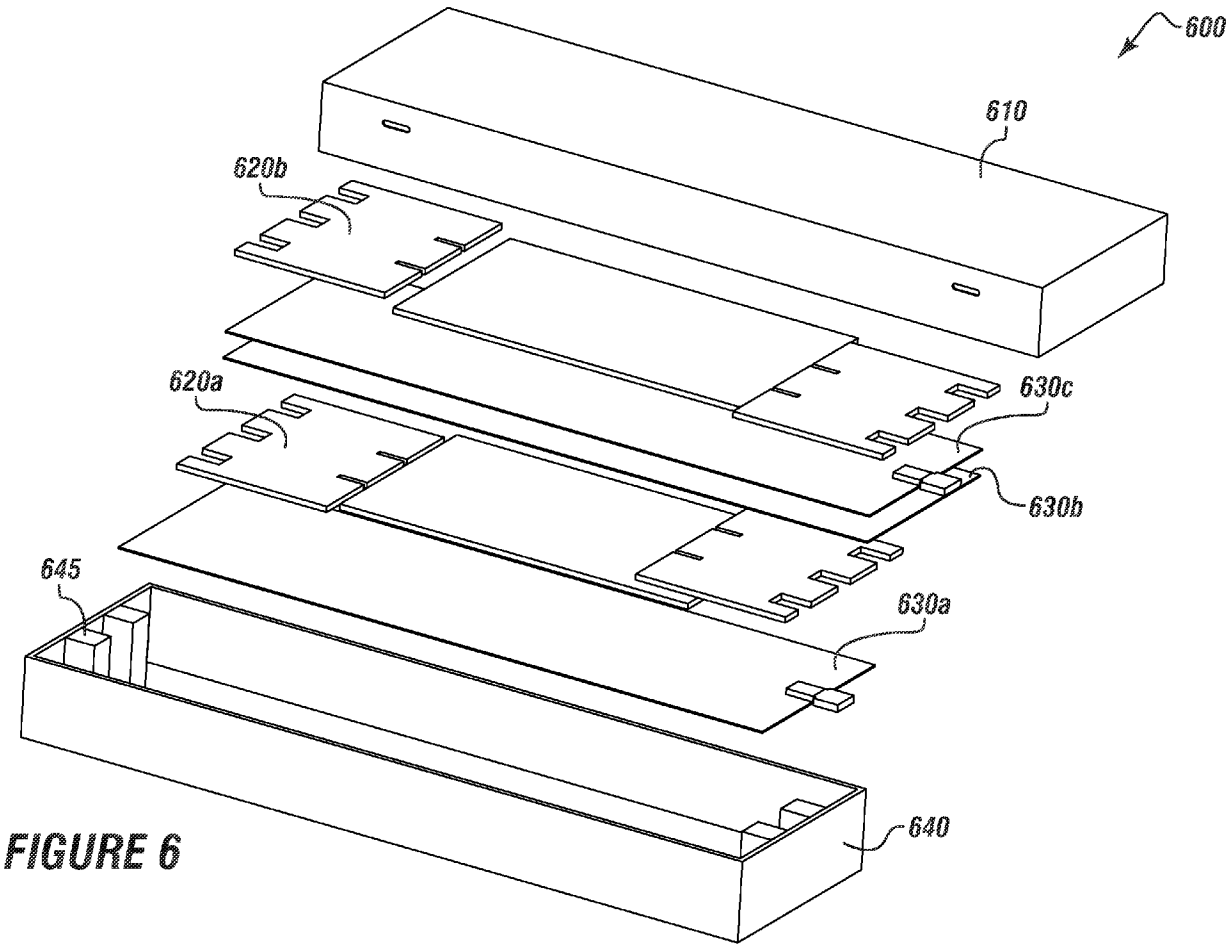
FIG. 6 depicts an exploded view of the crate of FIG. 5 depicting a method of assembling the crate according to one or more embodiments.

FIG. 6 depicts an exploded view of the crate of FIG. 5 depicting the method of assembling the crate 600 according to one or more embodiments. To assemble the crate 600, a first module 630*a* can be disposed within the base 640 with the corrugated blocks 645. A first insert with cuts 620*a* can be disposed on the first module 630*a*. One or more additional modules, such as modules 630*b* and 630*c*, can be placed on the first insert with cuts 620*a*. Then one or more additional inserts with cuts, such as an insert with cuts 620*b*, can be disposed on the modules 630*b* and 630*c*. This process can be repeated to accommodate any number of objects. The lid 610 can be disposed over the base 640.

Figure 7:
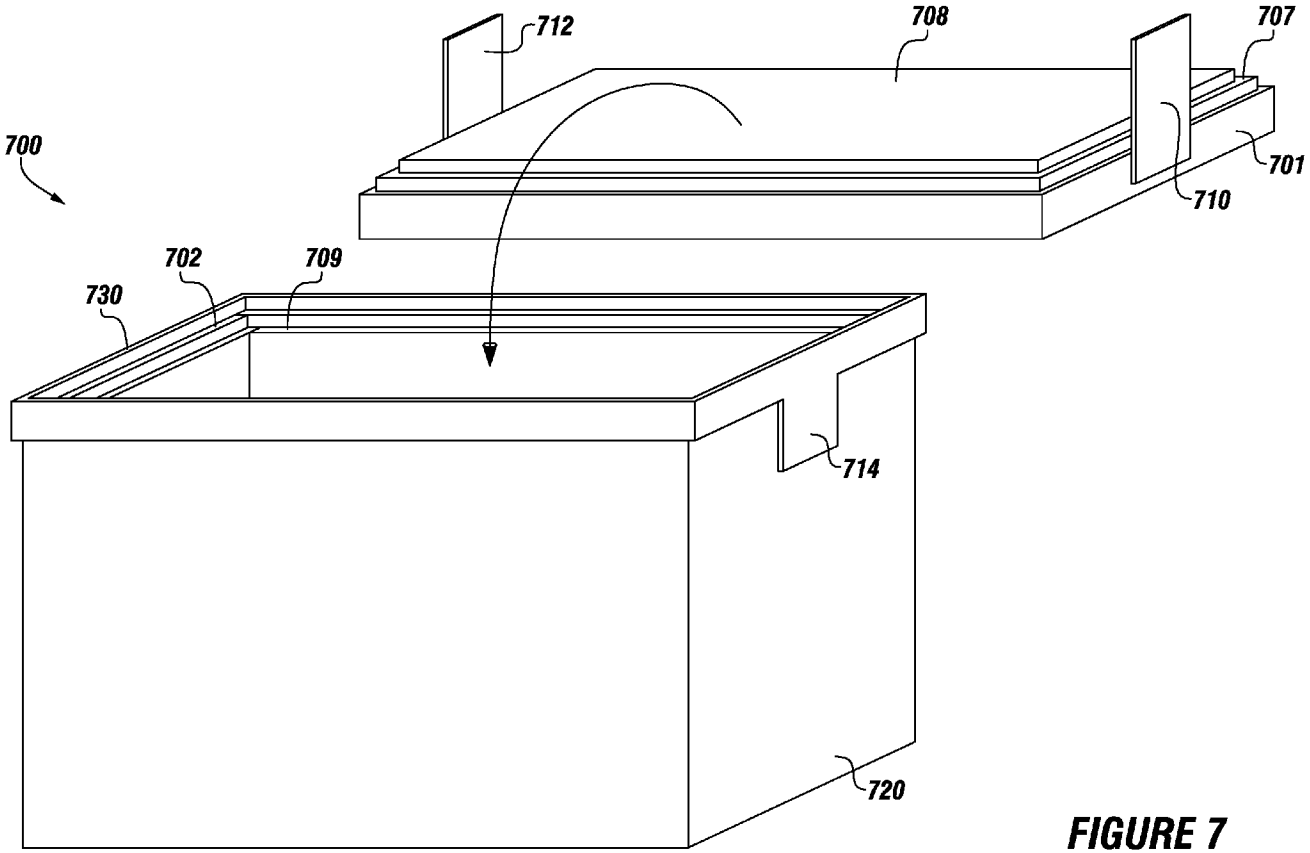
FIG. 7 depicts an embodiment of an additional crate according to one or more embodiments.

FIG. 7 depicts an embodiment of an additional crate according to one or more embodiments. The crate 700 can include a base 720 and a lid 701.

The base 720 can have a cavity formed between four sides. The sides can be made from cardboard or other material. The cavity can be configured to receive one or more objects. The base 720 can include one or more insulation layers 709 disposed within a channel. The insulation layers 709 can be foam. The foam can have any thickness. For example, the foam can be from about ½ inch thick to about 3 inches thick. One or more corrugated panels 702, such as four corrugated panels, can be disposed between the insulation layers 709. For example, each side of the base 720 can have a corrugated panel 702 disposed adjacent thereto, and each corrugated panel 702 can have an insulation layer 709 disposed adjacent thereto. The corrugated panels 702 can have any thickness. For example, the thickness of the corrugated panels 702 can be from about ½ inch to about 3 inches.

The base 720 can also include a U-channel 730 molded or secured to a top portion thereof. The U-channel 730 can also at least partially cover the corrugated panels 702.

The lid 701 can be made from cardboard, wood, metal, plastic, or other material. The lid 701 can have a top corrugated panel 707 secured thereto. The top corrugated panel 707 can have a top insulation layer 708 secured thereto. The top insulation layer 708 can have any thickness. For example, the thickness of the top insulation layer 708 can be from about ½ inch to about 3 inches. The top corrugated panel 707 can have any thickness. For example, the thickness of the top corrugated panel 707 can be from about ½ inch to about 3 inches.

The lid 701 can also include first connector portions 710 and 712. The first connector portions 710 and 712 can be configured to engage second connector portions, such a second connector portion 714 on the base 720. The first connector portions 710 and 712 can be a portion of a hook and loop fastener, an insert, a first portion of a snap latch, or similar mechanical fasteners. The second connector portion 714 can be a second portion of a hook and loop fastener, a receptacle configured to secure to an insert, a second portion of a snap latch, or a similar mechanical fastener.

Figure 8:
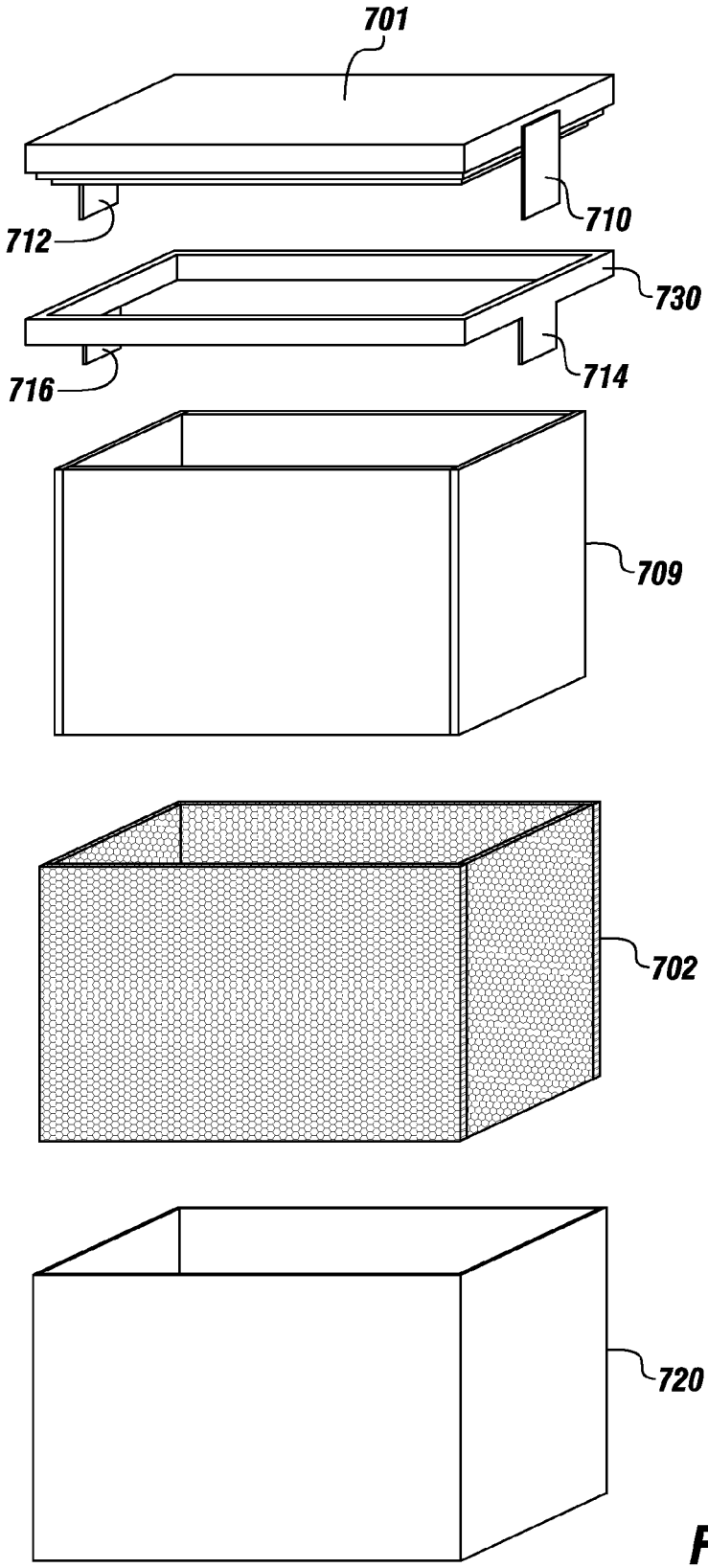
FIG. 8 depicts an exploded view of the crate of FIG. 7 according to one or more embodiments.

FIG. 8 depicts an exploded view of the crate of FIG. 7 according to one or more embodiments. To assemble the crate, the corrugated panels 702 can be inserted into the cavity of the base 720. The insulation layer 709 can be inserted between the corrugated panels 702. The U-channel 730 can be inserted on the top of the base 720 and secured to the top portion of the base 720 and to the corrugated panels 709.

The second connector portions 714 and 716 can be secured to the U-channel 730. The lid 701 can be secured to the base 720 by operatively engaging the first connector portions 710 and 712 to the second connector portions 714 and 716.

Figure 9:
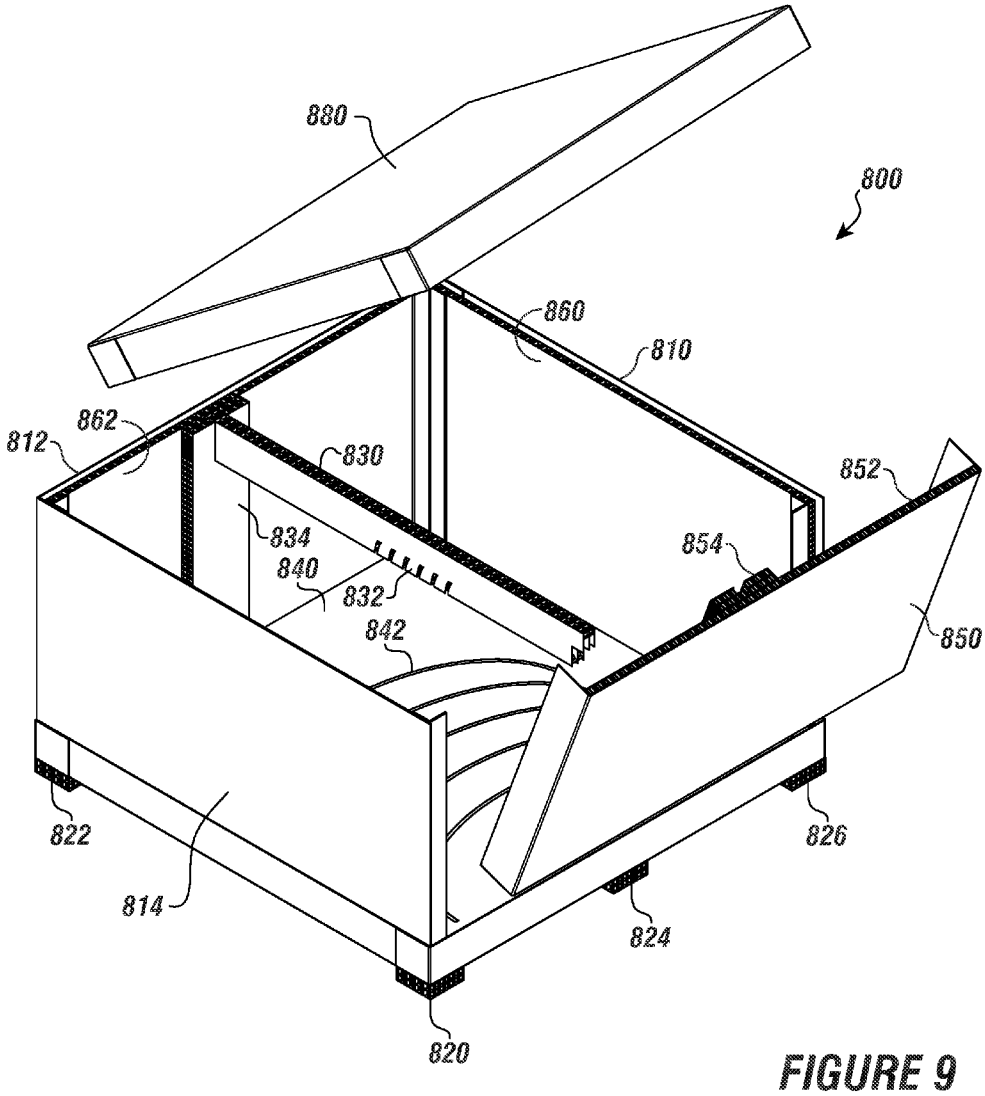
FIG. 9 depicts another crate according to one or more embodiments.

FIG. 9 depicts another crate according to one or more embodiments. The crate 800 can include a lid 880, one or more panels (three are shown 810, 812, and 814), a removable front panel 850, one or more runners (four are shown 822, 820, 824, and 826), one or more cuts 842, one or more corrugated beams 830, one or more corrugated supports (two are shown 834 and 854), one or more corrugated side panels (two are shown 860 and 862), and one or more front corrugated panels 852.

The lid 880 can be substantially similar to one or more lids disclosed herein. The panels 810, 812, and 814 can be substantially similar to one or more panels described herein. The removable front panel 850 can be substantially similar to one or more front panels described herein. The front corrugated panel 852 and the corrugated side panels 860 and 862 can be substantially similar to one or more corrugated panels described herein. The panels 810, 812, and 814, the lid 880, the base 840, and the removable front panel 850 can each have one or more corrugated panels disposed adjacent thereto.

The runners 822, 820, 824, and 826 can be similar to one or more runners disclosed herein. The runners 822, 820, 824, and 826 can support the crate 800.

The cuts 842 can be configured to support one or more portions of an object disposed within the crate 800. The cuts 842 can be formed into the base 840. The cuts 842 can have any shape and dimension. For example, the cuts 842 can be circular to support circular objects or cylindrical objects, square to support square objects, or other shapes to support other shaped objects.

The corrugated beam 830 can be disposed within the crate 800 and extend from one side thereof to another side thereof. For example, the corrugated beam 830 can extend from the second panel 812 to the removable front panel 850. The corrugated beam 830 can have one or more channels 832 formed therein. The channels 832 can be configured to support a portion of objects disposed within the crate 800. The channels 832 can have any dimension and shape.

The first corrugated support 834 can be disposed adjacent to one of the panels of the crate 800, such as to the second panel 812. The second corrugated support 854 can be disposed adjacent another panel of the crate 800, such as to the removable front panel 850. The corrugated supports 834 and 854 can be configured to support the corrugated beam 830.

Figure 10:
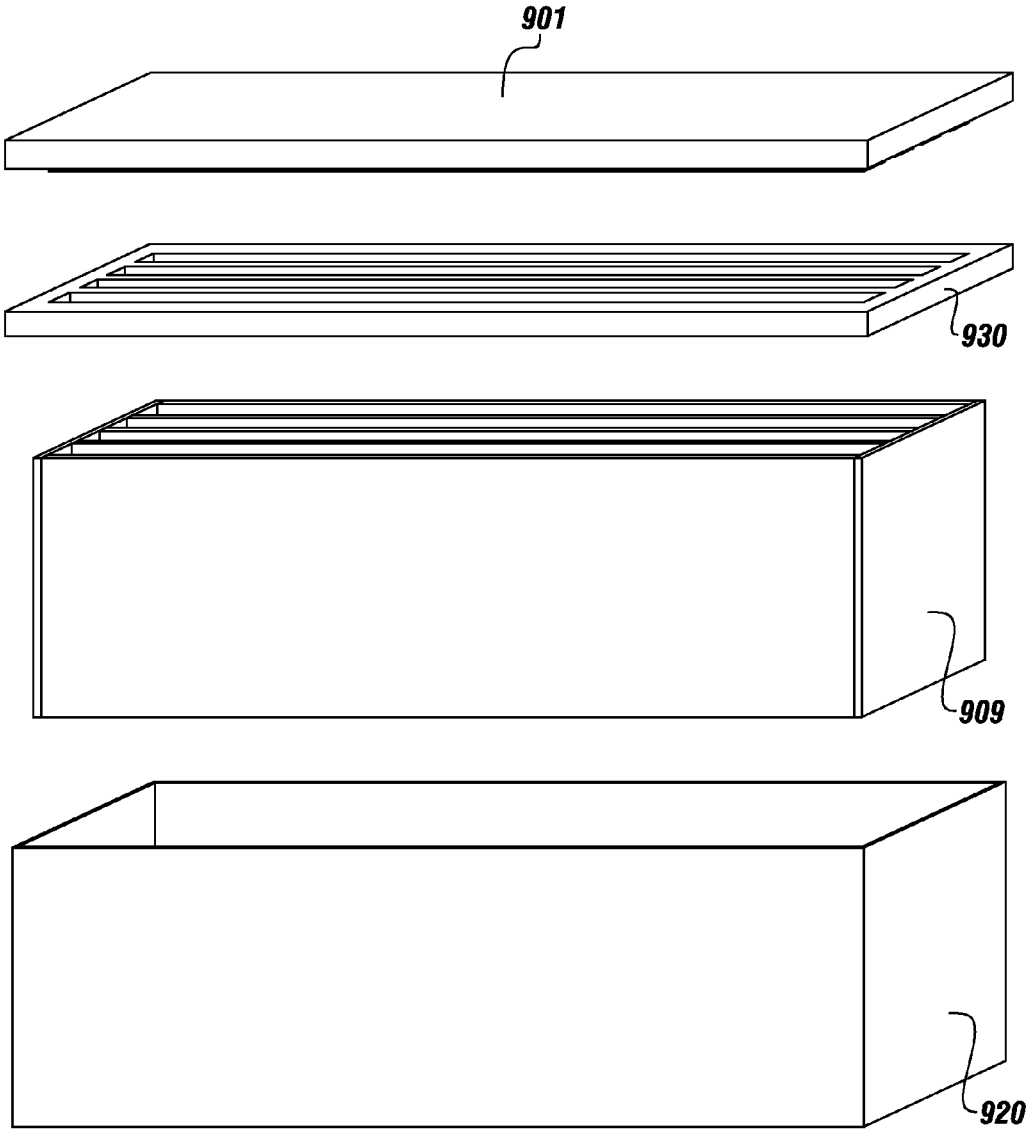
FIG. 10 depicts another crate according to one or more embodiments.

FIG. 10 depicts another crate according to one or more embodiments. The crate can include an outer box 920, such as a cardboard box. The outer box 920 can be any crate or box shell that is commercially available.

The crate can also include a plurality of partitions 909. The plurality of partitions 909 can be corrugated panels. For example, the plurality of partitions 909 can be HEXACOMB™ laminated with foam. The foam can be from about 0.25 inches to about 3 inches thick. The foam can be any commercially available foam.

The crate can also include U-channels 930 secured to at least a top portion of the plurality of partitions 909. The U-channels 930 can be secured to at least a top portion of the plurality of partitions 909 using commercially available adhesive, hook and loop fasteners, other mechanical fasteners, epoxy, lamination, or combinations thereof. In one or more embodiments, the U-channels 930 can be secured to a top portion of the plurality of partitions 909 and a top portion of the outer box 920.

The crate can also include a lid 901 for selectively sealing a cavity formed between the sides of the outer box 920.

While these embodiments have been described with emphasis on the embodiments, it should be understood that within the scope of the appended claims, the embodiments might be practiced other than as specifically described herein.

What is claimed is:

1. A crate made from cardboard configured to have increased compression strength, the crate comprising:

a. a base;

b. one or more cuts formed in the base;

c. a first side panel, a second side panel, and a back panel secured to the base, wherein the first side panel, the second side panel, and the back panel cooperate with the base to form a space for receiving an object;

d. a plurality of corrugated panels located within the space; wherein the corrugated panels are operatively positioned within the space to support the first side panel, the second side panel and the back panel;

e. a removable front panel, wherein the removable front panel is configured to removable secure with the first side panel and the second side panel;

f. a front corrugated panel secured to the removable front panel;

g. a top configured to removable secure with the first side panel, the second side panel, the back panel, and the removable front panel;

h. a first corrugated support connected with the back panel;

i. a second corrugated support connected with the removable front panel; and j. a corrugated beam that is supported by the first corrugated support and the second corrugated support, wherein the corrugated beam has one or more channels formed therein and wherein the one or more channels corporate with the one or more cuts to support an object disposed in the space.

2. The crate of claim 1, wherein the plurality of corrugated panels and the front corrugated panel comprise a corrugated material disposed between two sheets of material.

3. The crate of claim 1, further comprising two runners secured to an exterior of the base.

4. The crate of claim 3, wherein the two runners each comprise an outer housing at least partially encasing a corrugated material.

5. The crate of claim 1, further comprising one or more insulating panels adjacent one or more of the corrugated panels.

* * * * *